US007841800B2

(12) United States Patent
Gracia Bobed

(10) Patent No.: US 7,841,800 B2
(45) Date of Patent: Nov. 30, 2010

(54) MOUNTING FIXTURE AND DRUM ASSEMBLY

(75) Inventor: Ismael Gracia Bobed, Saragossa (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1046 days.

(21) Appl. No.: 11/037,635

(22) Filed: Jan. 18, 2005

(65) Prior Publication Data

US 2005/0160772 A1 Jul. 28, 2005

Related U.S. Application Data

(63) Continuation of application No. PCT/EP03/07437, filed on Jul. 9, 2003.

(30) Foreign Application Priority Data

Jul. 19, 2002 (ES) ..... 200201803

(51) Int. Cl.
*F16D 1/072* (2006.01)

(52) U.S. Cl. ..... 403/274; 403/280

(58) Field of Classification Search ..... 403/274, 403/280; 68/142; 34/604
See application file for complete search history.

(56) References Cited

U.S. PATENT DOCUMENTS 1,472,434 A * 10/1923 Oberg ..... 68/142
2,415,695 A * 2/1947 Cann
2,816,742 A * 12/1957 Richterkessing et. al. ..... 34/602
2,925,665 A * 2/1960 Smith
5,433,091 A * 7/1995 Durazzani et al.
5,740,589 A * 4/1998 Dominguez
6,279,357 B1 * 8/2001 Didlick et al. ..... 68/142
6,297,961 B1 * 10/2001 Koizumi et al.
6,401,363 B1 6/2002 Miramondi
6,502,295 B1 1/2003 Morgand

FOREIGN PATENT DOCUMENTS

| | | | |
|---|---|---|---|
| AT | 172176 | * | 8/1952 |
| DE | 3041506 | A1 | 6/1982 |
| DE | 3905495 | A1 * | 9/1989 |
| DE | 4326676 | A1 * | 2/1994 |
| DE | 4326496 | A1 | 2/1995 |
| DE | 19532783 | A1 * | 3/1996 |
| EP | 854223 | A2 * | 7/1998 |
| FR | 2752886 | A1 * | 3/1998 |
| GB | 1388731 | A | 3/1975 |
| GB | 2178067 | A * | 2/1987 |

OTHER PUBLICATIONS

Int'l Search Report.

* cited by examiner

*Primary Examiner*—Victor MacArthur
(74) *Attorney, Agent, or Firm*—James E. Howard; Andre Pallapies

(57) ABSTRACT

The drum (1) is fixed to a mounting star (2), on which a shaft (4) for drive of the drum is fixed. The fixing is achieved by means of arrangement of several openings (6) in the mounting star (2) with different entry and exit diameters, whereby a tip (8) corresponding to each opening (6) is arranged on the drum (1), which is introduced through the smallest hole in the opening (6). The tip (8) is subsequently deformed such that the outer surface thereof is pressed against at least the walls (7) of the opening (6), whereupon the fixing is generated.

9 Claims, 3 Drawing Sheets

MOUNTING FIXTURE AND DRUM ASSEMBLY

OBJECT OF THE INVENTION

The invention relates to a method for fixing the rear wall of a drum of a washing machine on a mounting star, on which the drum is swivel-mounted via an axis and fixing, which is achieved by means of the method. The object of the invention is to provide fixing with features which enable greater loads to be endured when the drum is rotating, especially in washing machines which tumble at high speeds.

GENERAL PRIOR ART

It is known that drums of washing machines with rotation capacity are arranged in the interior of a container, for which purpose they are attached on a mounting (known as mounting star), which is connected to a rotating axis, powered by a suitable motor. The mounting star is star shaped, and its mounting arms are fixed on the drum. A known embodiment for fixing the mounting arms on the drum provides screwing the ends of the mounting arms on a peripheral projection, formed on the rear wall of the drum.

In the past the decision has been made to rivet the end of each mounting arm of the mounting star on the rear wall of the drum itself instead of the screw connections on the peripheral projection and by means of a metallic reinforcing plate, by means of which the bond for mounting the drum is made.

DESCRIPTION OF THE INVENTION

These known methods of fixing have disadvantages. In the first case the loads, which occur when the drum rotates at high speeds, are absorbed by the points, at which the connection of the end of the mounting arms is made with the peripheral projection of the drum. This can, especially with high-speed tumbling, cause tearing in the drum, or the mounting points cannot withstand the loads at high speeds.

In the second case the necessary metallic reinforcing plates are cause for high costs of the fixing method. Also, there is only fixing for each of the mounting arms of the mounting star, whereby the mounting points for drums rotating at high tumbling speeds are not solid enough despite the strengthening by the reinforcing plate.

In order to eliminate the abovementioned disadvantages the object of the invention is to develop a novel fixing method for the drum of a washing machine, in which the mounting star for the rotating axis and its fixing are less expensive but still more stable.

The method according to the invention solves this task in that the rear wall of the drum on the mounting star is attached at several openings of the mounting star with entry and exit diameters of differing size, in that for each opening a tip is drawn through the entry with the smaller diameter from the sheet of the rear wall of the drum in the assigned opening, in that then the tip is widened out against the walls of the opening, which establish the major difference between the entry and exit diameters of the opening.

The inventive method provides that deformation of the already drawn tip is made by use of a press tool, in that the press tool with a complementary surface matching the truncated surface of the late tip form is guided through the larger hole and the upper part of the tip and presses against the inside of the tip, resulting in its final form.

The method of the invention can be applied to any configuration of the mounting star. But since the latter conventionally has a star shape, the inventive method provides that there is at least one opening for a tip provided in the drum rear wall in each mounting arm of the star.

In an embodiment of the invention the walls of the opening, against which the corresponding tip of the drum presses, have a surface which widens in the direction of the upper end of the tip, such that when the tip deforms the latter opens in the direction of said surface and presses against the surface. This produces the fixing between the mounting star and the drum.

Widening of the walls of the opening, against which the tip presses, can take on any configuration. In the preferred embodiment it has a truncated shape, preferably in its entirety determined by the tip.

There is also the possibility that the walls of the opening, which determine the major difference between the entry and exit diameters and against which the respective tip of the drum presses, contain at least one graduation, to which the tip adapts when deforming and pressing.

A further embodiment contains in the truncated area of the opening several graduations for fixing the drum even more securely.

Obviously, in each mounting arm of the mounting star a sufficiently large number of holes can be made, as is adapted to the demands made on the drum depending on the desired tumbling speed, and in this way fixing takes place at different sites on the mounting arms.

In addition, the method according to the invention offers the possibility, to add at least one lateral widening at least in an area of the mounting arms, in which at least one opening is made, in which a corresponding tip of the drum is held. Where the mounting star is configured as a star-shaped component at least one lateral widening is arranged at the lateral ends of each mounting arm.

The inventive method can provide that the tip of the drum is designed by means of a press-in process.

The fixing obtained by means of the method of the invention is characterised in that the mounting star has several openings with various entry and exit diameters, in which in each case one tip is inserted from the smaller entry diameter, which is drawn from the rear wall of the drum, such that the tip presses at least against that area of the walls of the opening, which determine the differences between the entry and exit diameters.

The walls of the opening of the mounting star, with which the fixing is executed, as well as the mounting star itself and the drum exhibit those features which have already been described in the method according to the invention.

Hereinbelow a series of figures is attached, in which the object of the invention is explained and illustrated in a non-limiting way for better comprehension of the description and as part thereof.

DETAILED DESCRIPTION OF THE INVENTION

A drum 1 and a mounting star 2 are partially illustrated in the figures. Because these are well-known elements, a complete illustration of all these elements was omitted.

The drum 1 is fixed on the outside of its rear wall on the mounting arms 3 of the mounting star 2, which is configured star shaped.

The mounting star 2 for its part is connected solidly to a shaft 4, which is connected to a drive motor (not illustrated here) to generate the rotation of the drum 1 in a lye container, not illustrated.

Figure 4:
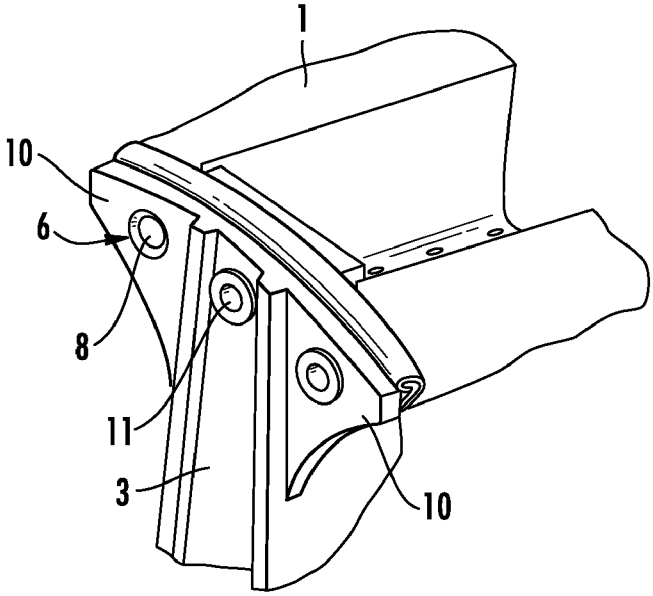
FIG. 4 is a perspective partial view of another embodiment of the ends of the mounting arms, in each of which a lateral widening is started, which is fixed by means of the inventive method on the drum, and this figure also shows the fixing of the end of the mounting arm, in which the fixing is strengthened by means of conventional riveting and a metal plate.
Figure 5:
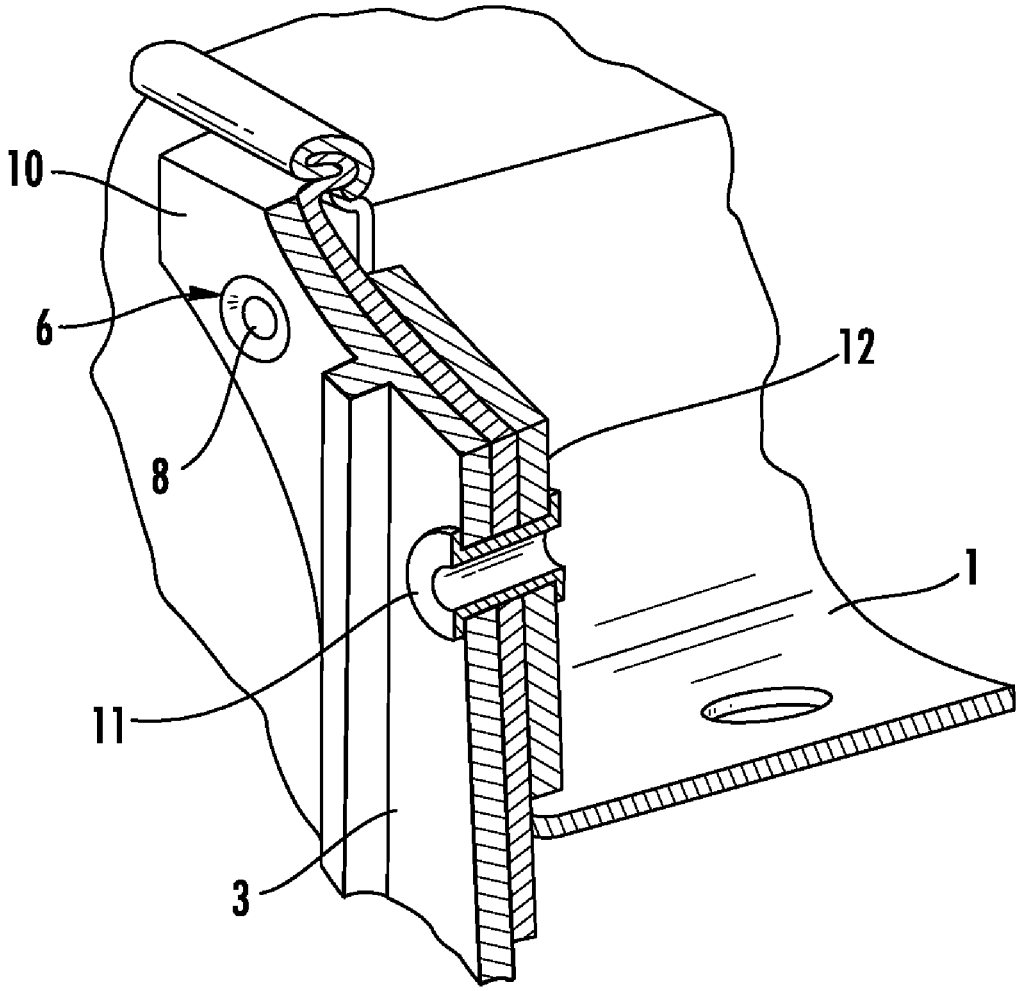
FIG. 5 shows a detail from the example of FIG. 4, in which the fixing is strengthened by conventional means and by a metal plate.

The rear wall of the drum 1 is fitted with grooving 5 in a star shape, in which the mounting arms 3 of the mounting star 2 are situated. One of the fixings, which are conventionally used to connect the ends of the mounting arms 3 of the mounting star 2 to the drum 1, comprise attaching a rivet 11 (FIGS. 4 and 5) by means of interposing a metal plate 12, which reinforces the connection, as insufficiently described above by way of the prior art as for washing machines, which tumble at a very high speed.

For this reason the invention proposes an alternative or complementary fixing to the fixing produced by conventional means, for which reason at least one opening 6 with a wall having a truncated shape is designed in each mounting arm 3 of the mounting star 2, which determine an entry of Greater diameter than the exit.

Figure 1:
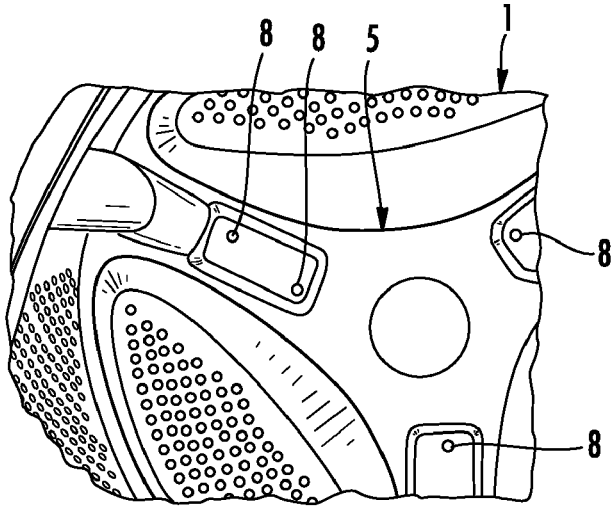
FIG. 1 is a perspective partial view of the interior of the drum, on the rear of which the tips are recognisable, which are designed by pressing in for fixing of the mounting star and which are located on the outside of the drum.
Figure 2A:
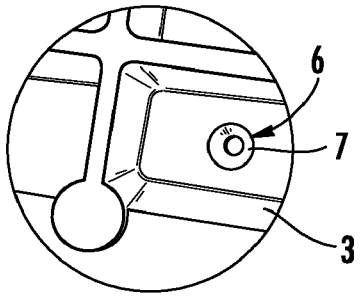
FIG. 2 is a perspective partial view of the outside of the drum and of one of the mounting arms of the mounting star, on which it is fixed, whereby a detail of the opening is also to be seen, which is placed in the mounting star for configuring the fixing of the tip of the drum.
Figure 2B:
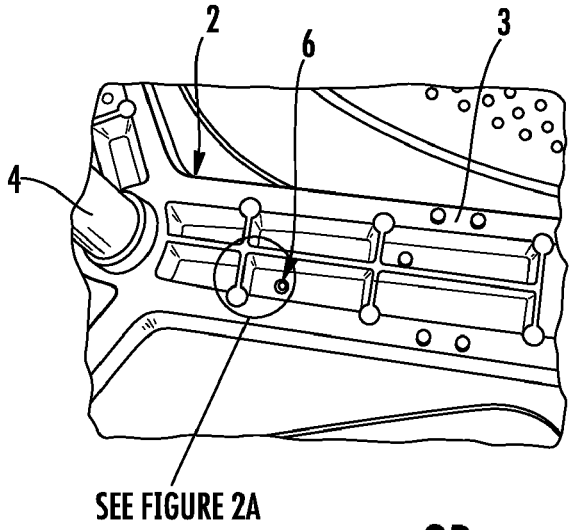
Figure 3A:
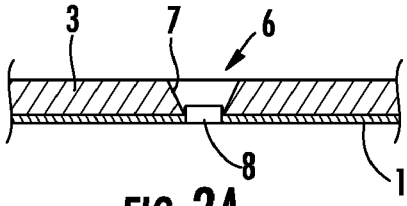
FIGS. 3*a* to 3*d* are a schematic illustration of the different sequences provided by the inventive method for carrying out the fixing of the mounting star with the drum.
Figure 3B:
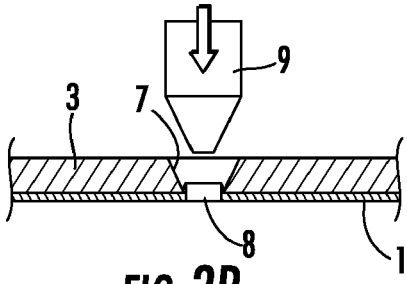

In the embodiment two openings are made for in each case one of the mounting arms, but there is the possibility of arranging one opening or more as two, depending on the loading of the drum caused by the tumbling speed. Arranged on the rear wall of the drum 1 and the number of openings 6 are one or more tips 8, which project outwards, so that each tip 8 can be housed in the opening 6, as in FIG. 3*a*. The tip 8 can be created by pressing or drawing from the inside of the rear wall of the drum 1.

Figure 3C:
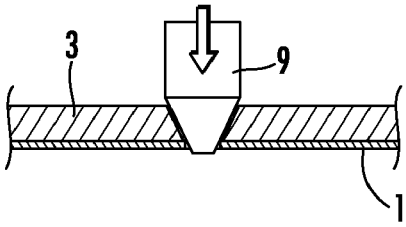
Figure 3D:
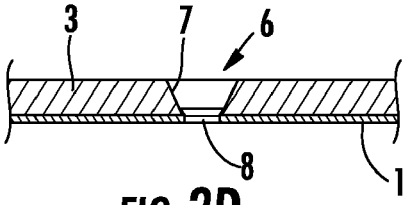

When the tip 8 is introduced into the opening 6, a drift punch 9 is guided through the outside (greater diameter) of the opening 6, whereby the drift punch 9 a truncated mantle surface has, which corresponds to the truncated surface 7 of the opening 6. When the drift punch 9 lowers its lower end enters the tip 8, so that the tip 8 widens until it presses against the truncated walls 7 of the opening 6 (FIG. 3*c*), so that when the drift punch 9 is removed (FIG. 3*d*) the fixing of the drum 1 on the mounting star 2 is completed. In this way fixing with several mounting points is achieved, which share the load, thus guaranteeing greater resistance.

The truncated wall 7 can contain a graduation (not shown in the figures). In this case the drift punch 9 must contain a corresponding graduation, to be able to exert the correct and as far as possible whole-surface pressure with respect to the tip 8 on the walls of the opening.

The invention also provides that, if wanted, for greater loads respective widening 10 can be provided at the ends of the mounting arms 3 of the mounting star, in which there is at least one opening 6, to execute the fixing according to the invention, whereby also a conventional connection can be provided by means of the abovementioned rivet 11.

The invention claimed is:

1. A mounting fixture and drum assembly for a washing machine, the assembly comprising:

a mounting fixture operable to be supported within the washing machine for rotation of the mounting fixture about a rotation axis, the mounting fixture having a distal side and a proximal side and a tip receiving opening extending through the mounting fixture from the distal side to the proximal side, the tip receiving opening having a distal open end, a proximal open end, and an axial extent extending between the distal and proximal open ends, the proximal open end of the tip receiving opening being located at the proximal side of the mounting fixture and the distal open end of the tip receiving opening being located at the distal side of the mounting fixture and having a cross-sectional area that is larger than the cross-sectional area of the proximal open end of the tip receiving opening; and a drum having one end and another end axially opposite to the one end, the one end of the drum having a tip extending axially outwardly from the drum and the one end of the drum connected to the mounting fixture, the tip of the one end of the drum extending through the proximal open end of the tip receiving opening of the mounting fixture and extending at least partially along the axial extent of the tip receiving opening of the mounting fixture, and a portion of the tip that extends along the axial extent of the tip receiving opening of the mounting fixture having a cross-sectional area larger than the cross-sectional area of the proximal open end of the tip receiving opening.

2. The mounting fixture and drum assembly as claimed in claim 1, wherein the mounting fixture includes a mounting star having multiple arms extending radially outwardly from a shaft and at least one of the arms includes the tip receiving opening.

3. The mounting fixture and drum assembly as claimed in claim 2 and further comprising a rivet and the one end of the drum includes a rivet through bore and one of the remaining arms of the mounting star includes a rivet opening, the rivet including an axial extent that extends through the rivet through bore of the one end of the drum and the rivet opening of the said one of the remaining arms of the mounting star.

4. The mounting fixture and drum assembly as claimed in claim 1, wherein the mounting fixture includes a mounting star having multiple arms extending radially outwardly from a shaft and one of the arms includes the tip receiving opening and the remaining arms each includes a tip receiving opening extending through the mounting fixture from the distal side to the proximal side, the tip receiving opening of each of the remaining arms having a distal open end, a proximal open end, and an axial extent extending between the distal and proximal open ends, the proximal open end of the tip receiving opening being located at the proximal side of the mounting fixture and the distal open end of the tip receiving opening being located at the distal side of the mounting fixtures and having a cross-sectional area that is larger than the cross-sectional area of the proximal open end of the tip receiving opening, and the drum includes multiple tips extending outwardly from the drum with each tip of the one end of the drum extending through the proximal open end of a respective tip receiving opening of the mounting fixture and extending at least partially along the axial extent of the respective tip receiving opening of the mounting fixture, and a portion of the tip that extends along the axial extent of the tip receiving opening of the mounting fixture having a cross-sectional area larger than the cross-sectional area of the proximal open end of the respective tip receiving opening.

5. The mounting fixture and drum assembly as claimed in claim 4, wherein the portion of each respective tip that extends along the axial extent of a respective tip receiving opening of the mounting fixture terminates at a tip portion end and each tip receiving opening has a surface that widens at least partially in the direction of the tip portion end of the respective tip.

6. The mounting fixture and drum assembly as claimed in claim 5, wherein each tip receiving opening has a truncated conically shape surface.

7. The mounting fixture and drum assembly as claimed in claim 5, wherein each tip receiving opening has at least one graduation to which the respective tip extending within the tip receiving opening is adapted positively.

8. The mounting fixture and drum assembly as claimed in claim 5, wherein each tip receiving opening has a truncated conically shaped surface including at least one graduation to which the respective tip extending within the tip receiving opening is adapted positively.

9. The mounting fixture and drum assembly as claimed in claim 1, wherein the tip receiving opening has a truncated shape defining a truncated inner surface and the portion of the tip has a corresponding truncated shape defining a truncated external surface engaging the truncated inner surface and resisting the tip from exiting the tip receiving opening.

* * * * *